US011221171B2

(12) United States Patent
Chao

(10) Patent No.: US 11,221,171 B2
(45) Date of Patent: Jan. 11, 2022

(54) REFRIGERATED LOGISTICS BOX

(71) Applicants: Chien-Shun Chao, Taichung (TW); Xiangdong Shi, Beijing (CN)

(72) Inventor: Po-Han Chao, Taichung (TW)

(73) Assignees: Chien-Shun Chao, Taichung (TW); Xiangdong Shi, Beijing (CN)

( * ) Notice: Subject to any disclaimer, the term of this patent is extended or adjusted under 35 U.S.C. 154(b) by 187 days.

(21) Appl. No.: 16/705,628

(22) Filed: Dec. 6, 2019

(65) Prior Publication Data

US 2020/0378674 A1 Dec. 3, 2020

(30) Foreign Application Priority Data

May 27, 2019 (TW) ..... 108206642

(51) Int. Cl.

*F25D 11/00* (2006.01)
*F25D 19/00* (2006.01)
*F25D 17/02* (2006.01)

(52) U.S. Cl.

CPC ..... *F25D 11/003* (2013.01); *F25D 17/02* (2013.01); *F25D 19/003* (2013.01); *F25D 2201/10* (2013.01)

(58) Field of Classification Search

CPC ..... F25D 11/003; F25D 17/02; F25D 19/003; F25D 2201/10; F25D 2400/12; F25D 3/107; F25D 3/105; F25D 3/10; F25D 2331/804; B65D 8/744; F25B 21/02

See application file for complete search history.

(56) References Cited

U.S. PATENT DOCUMENTS 4,320,626 A * 3/1982 Donnelly ..... F25D 31/003 62/3.64
5,653,111 A * 8/1997 Attey ..... F04D 13/0673 165/170
2020/0216254 A1* 7/2020 Tanabe ..... F24F 11/64
2020/0373638 A1* 11/2020 Lee ..... H01M 10/613

FOREIGN PATENT DOCUMENTS

CN 209871312 U * 4/2019

OTHER PUBLICATIONS

CN209871312U translation.*

* cited by examiner

*Primary Examiner* — Elizabeth J Martin
(74) *Attorney, Agent, or Firm* — Muncy, Geissler, Olds & Lowe, P.C.

(57) ABSTRACT

A refrigerated logistics box, consisting of a box, is configured with a plurality of thermal insulating layers and temperature equalization plates. Cooling liquid is caused to enter the interior of the box to maintain a cold temperature therein for a period of time, or a refrigeration device provides the box with a cold source, which continuously transmits cold to the interior of the box, and cooling liquid inside the box is caused to flow back into the refrigeration device to repeat the cooling process. Such a cyclic cooling process maintains the temperature set for the interior of the box.

4 Claims, 11 Drawing Sheets

REFRIGERATED LOGISTICS BOX

BACKGROUND OF THE INVENTION

(a) Field of the Invention

The present invention relates to a refrigerated logistics box, and more particularly to a refrigerated logistics box comprising a box that is configured with a plurality of thermal insulating layers and temperature equalization plates. A cooling liquid is caused to cool enter the interior of the box to maintain a cold temperature therein for a period of time, or a refrigeration device provides the box with a cold source, which continuously transmits cold into the interior of the box, thereby maintaining the temperature set for the interior of the box and lowering the temperature of goods placed inside, while maintaining a cold temperature in the interior of the box. The present invention is distinct from high cost, high fuel consumption, and large sized refrigeration equipped logistics vehicles. The box maintains goods placed inside at a constant temperature; moreover, the required battery is small in size due to its low power consumption, convenient, and of low cost, and is, thus, suitable for carrying by general trucks and motor vehicles.

(b) Description of the Prior Art

It is well known that logistics services providers deliver goods from a consignor to the residence of the consignee; and is currently one of the essential prerequisites for developing and prevailing online shopping operators. However, because logistics services providers must quickly deliver the goods to the designated place, with all manner of goods being delivered, including goods requiring cold storage, such as fresh products, ice products, frozen food products, and the like. Hence, normally, the logistics services provider adopts two models for delivering goods requiring cold storage, one is to use a logistics vehicle fitted with refrigerating equipment, which is able to cold store fresh products, ice products, frozen food products, and the like, at a low temperature for a relatively long period of time. Nonetheless, cost expenditure is relatively large and the vehicle is large in size (a logistics vehicle fitted with refrigerating equipment is equipped with a compressor, which requires a large power expenditure with a power source coming from an electric generator that derives its power from running an internal combustion engine, and running the internal combustion engine requires the consumption of gasoline). The other model uses a low temperature insulation box, which for a short period of time provides a low temperature for goods requiring cold storage. However, the low temperature insulation box has no power source to maintain a low temperature and relies on thermal insulating layers to separate the interior of the low temperature insulation box from the outside temperature. Hence, the low temperature insulation box is only able to maintain a low temperature for a short period of time, thus, both its thermal insulation and period of effectiveness are limited, with numerous drawbacks occurring because of this, such as cold storage goods regularly thawing or spoiling.

SUMMARY OF THE INVENTION

Traditional logistics services providers are currently unable to make a breakthrough in the cold storage equipment delivery period, being hindered by the fact that cold storage equipment is only available in high cost logistics vehicle provided with refrigerating equipment. And a low temperature insulation box can only be used to deliver goods over short periods of time, and thus a cause for worry for both consumers and logistics services providers alike.

Accordingly, a refrigerated logistics box of the present invention comprises:

a box for logistics use, which is provided with a cold storage space and a cover, wherein the box is configured with a plurality of thermal insulating layers and temperature equalization plates; the box is separated from outside-in into an outer thermal insulating layer, a plurality of vacuum plates, an inner thermal insulating layer, an inner wall plate, and a plurality of temperature equalization plates; a cooling space is provided between the inner wall plate and the temperature equalization plates, and an inner space surrounded by the temperature equalization plates is a cold storage space; and a return outlet flow pipe and a return inlet flow pipe, which respectively channel cooling liquid out of and into the cooling space.

Accordingly. a cooling liquid is channeled into the cooling space from the return inlet flow pipe, causing the cold storage space of the box to lower in temperature. When the temperature of the cold storage space rises, the original cooling liquid is channeled out from the return outlet flow pipe, whereupon newly cooled liquid is again channeled into the cooling space from the return inlet flow pipe.

The primary object of the present invention lies in providing the box configured with the plurality of thermal insulating layers and temperature equalization plates to enable a cooling liquid to enter the inside of the box and maintain a cold temperature therein for a period of time.

A second object of the present invention lies in providing a refrigeration device connected to the logistics box, which enables lowering the temperature of goods placed inside while maintaining a cold temperature, and is distinct from high cost, high fuel consumption, and large sized refrigerating equipment logistics vehicles, as well as being distinct from cold storage logistics boxes that are only able to provide temporary thermal insulation.

A third objective of the present invention lies in providing the refrigeration device with the function to maintain continuous temperature control, thereby maintaining goods placed inside the box at a constant temperature; moreover, the required battery is small in size due to its low power consumption, as well as being convenient and low in cost, thus suitable for carrying by general trucks and motor vehicles.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
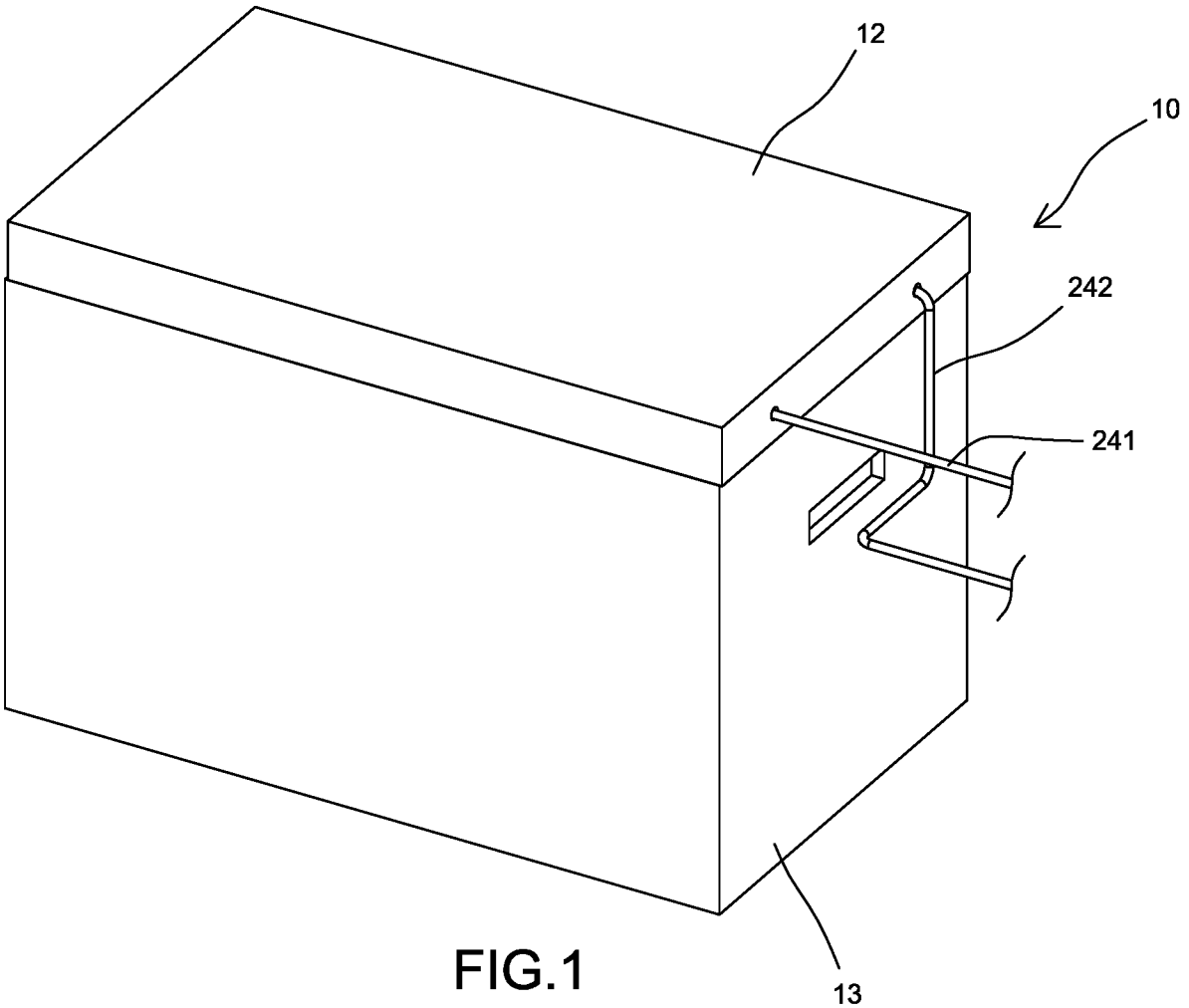
FIG. 1 is a three-dimensional schematic view of a first embodiment of the present invention.
Figure 2:
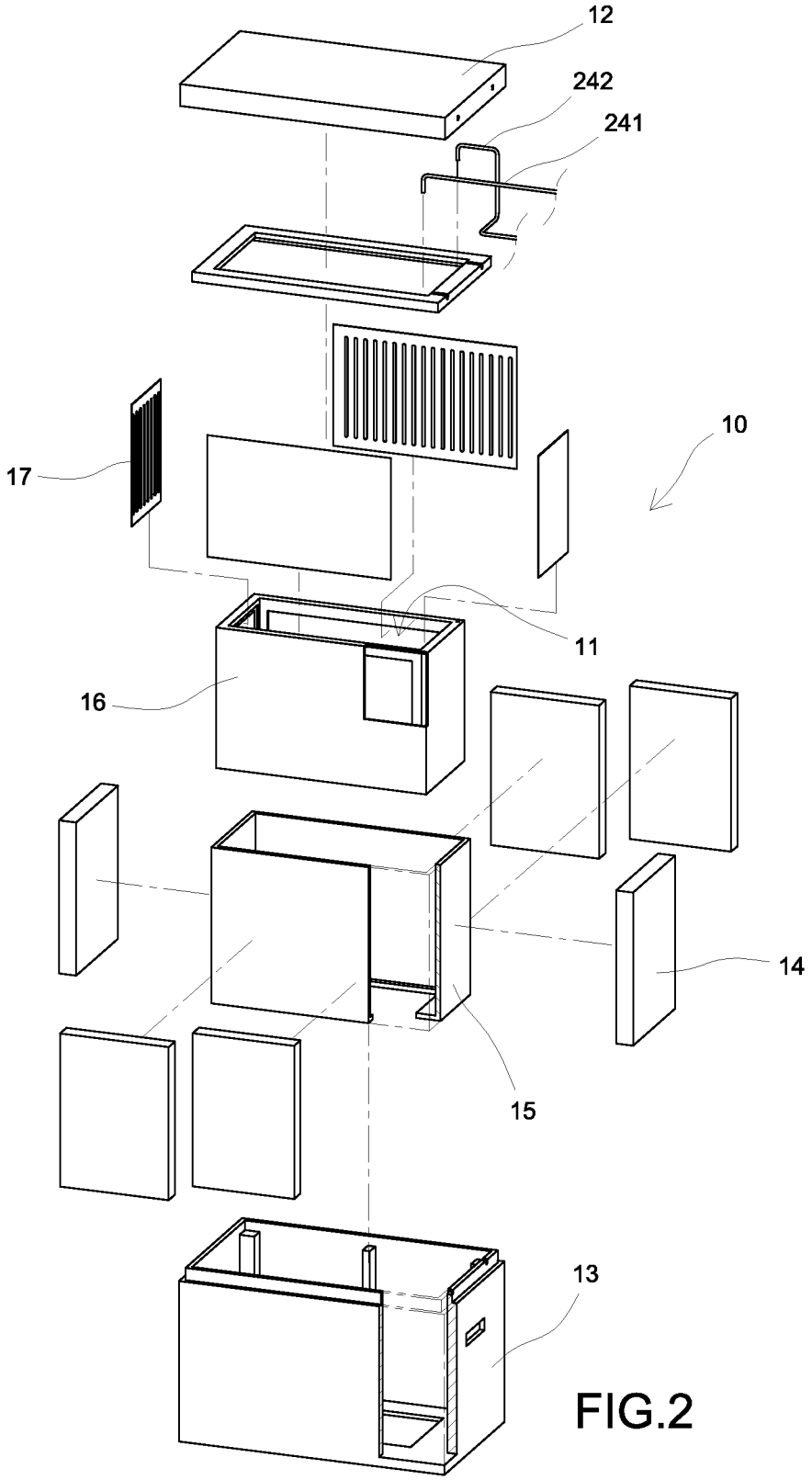
FIG. 2 is an exploded three-dimensional schematic view of a box of the first embodiment of the present invention.
Figure 3:
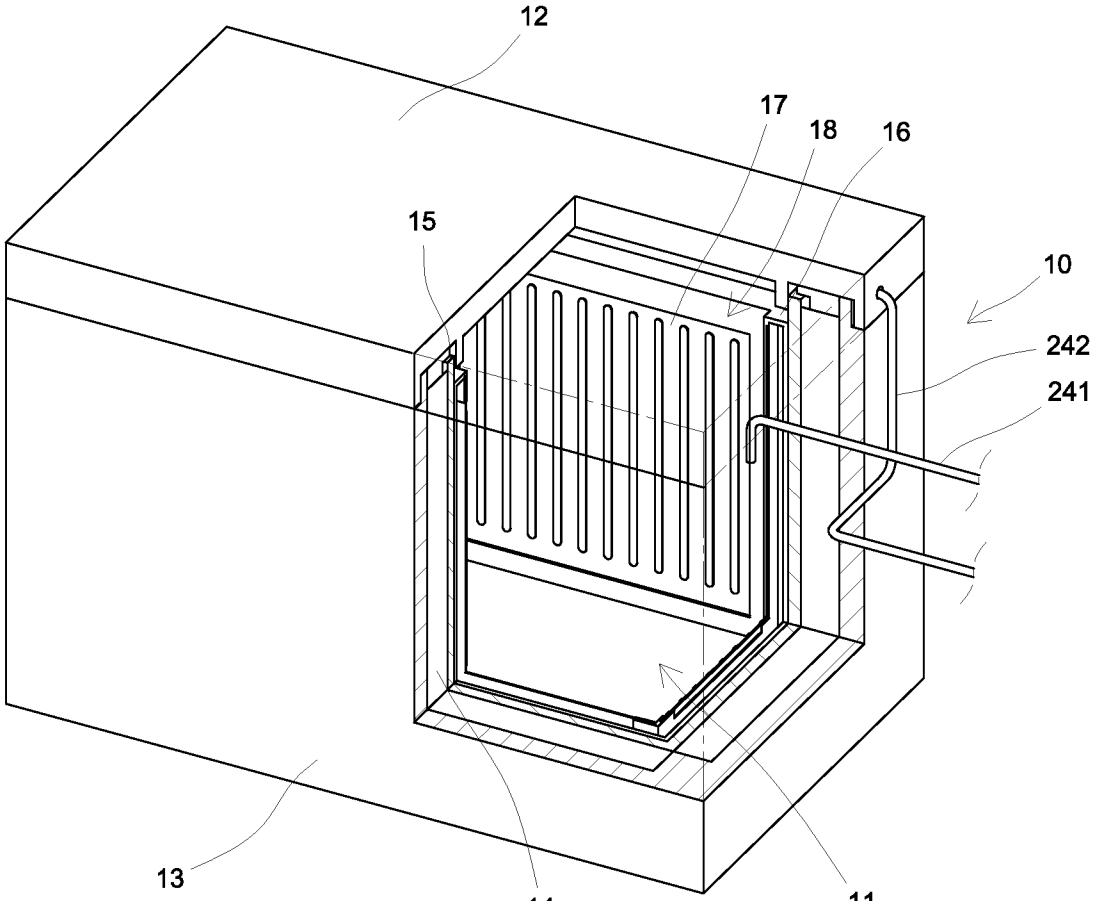
FIG. 3 is a three-dimensional schematic view of a partial cutaway of the first embodiment of the present invention.
Figure 4:
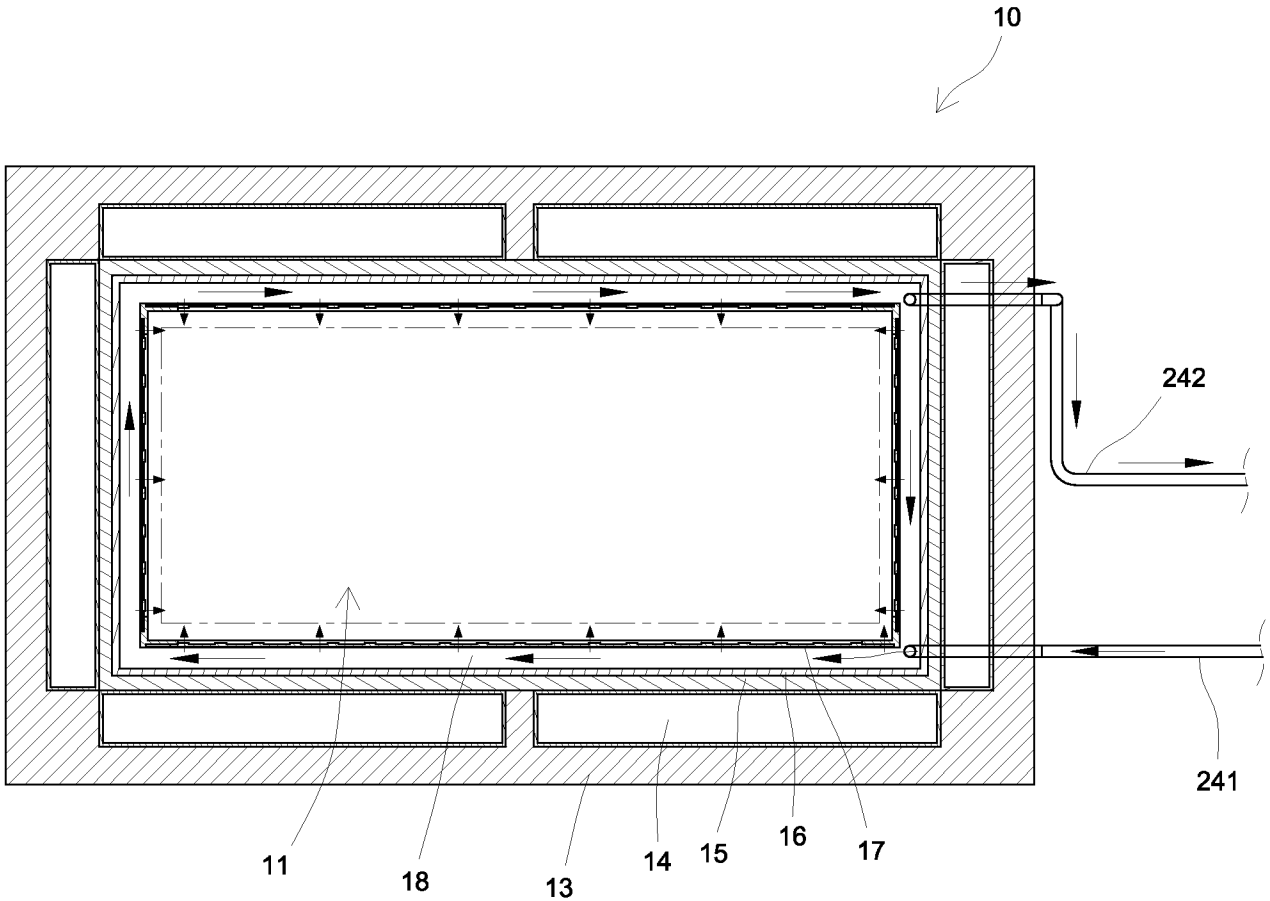
FIG. 4 is a horizontal cross-sectional schematic view of the box of the first embodiment of the present invention.
Figure 5:
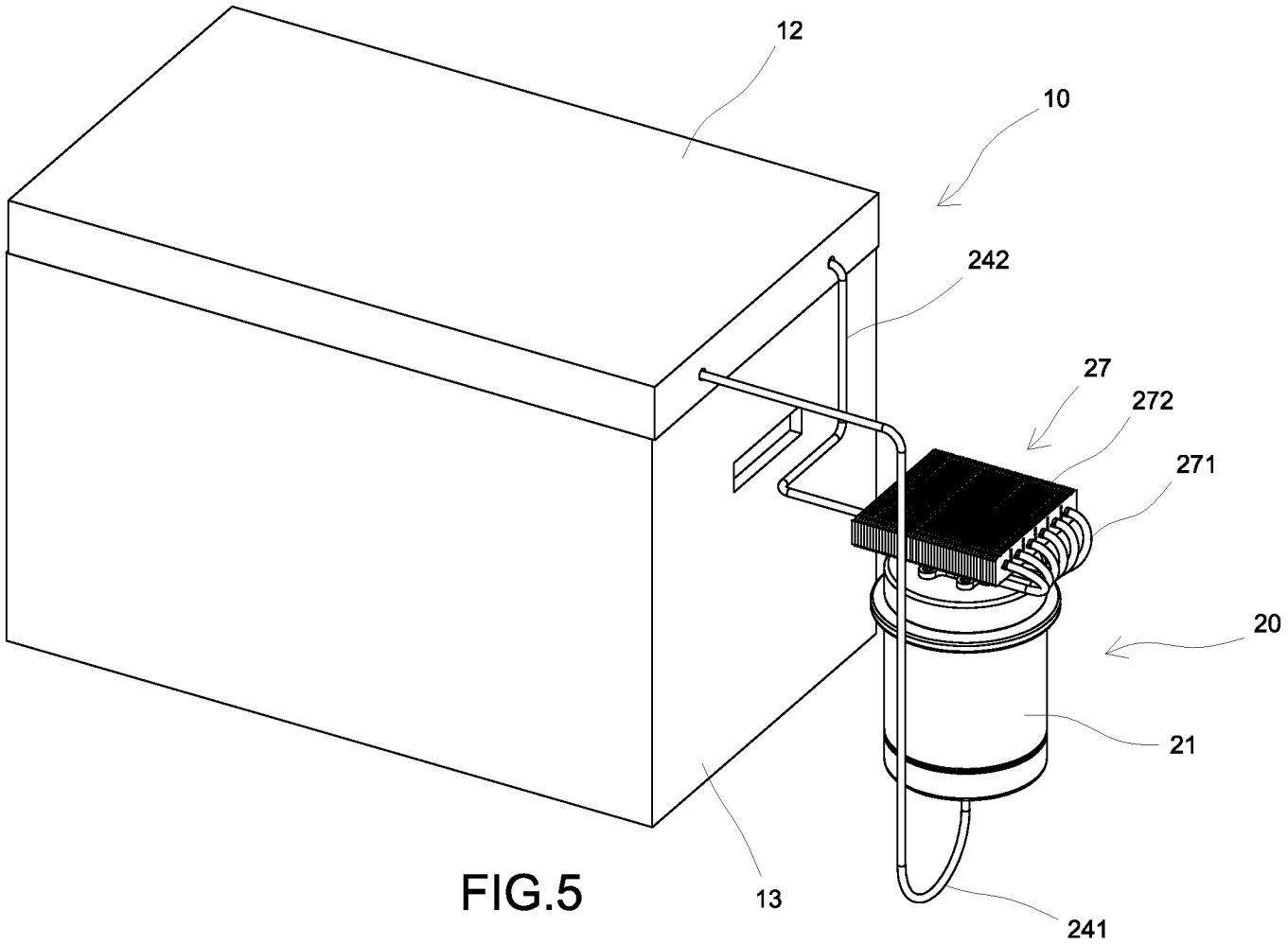
FIG. 5 is a three-dimensional schematic view of a second embodiment of the present invention.
Figure 6:
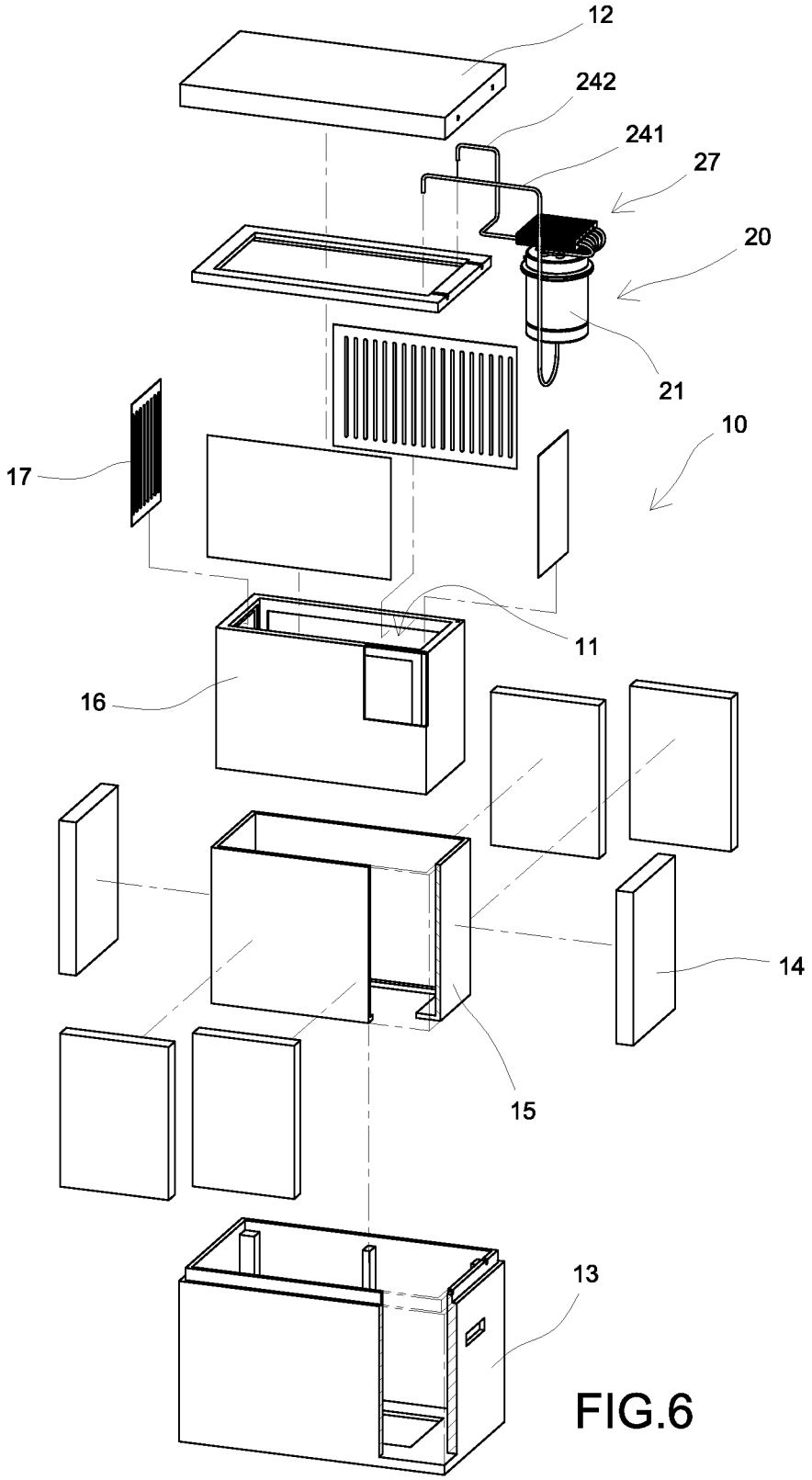
FIG. 6 is an exploded three-dimensional schematic view of the box and the refrigeration device of the second embodiment of the present invention.
Figure 7:
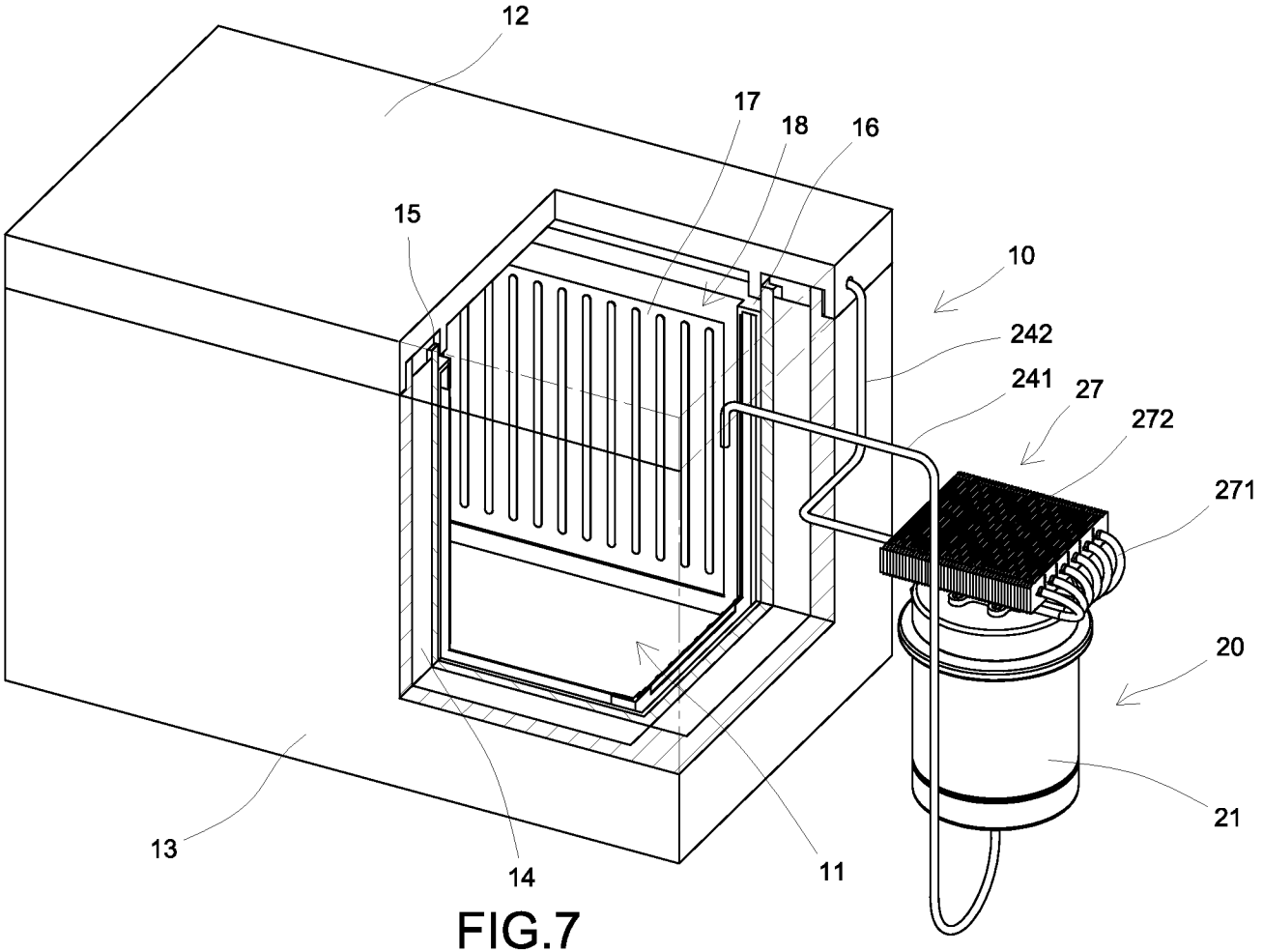
FIG. 7 is a three-dimensional schematic view of a partial cutaway of the box of the second embodiment of the present invention.
Figure 8:
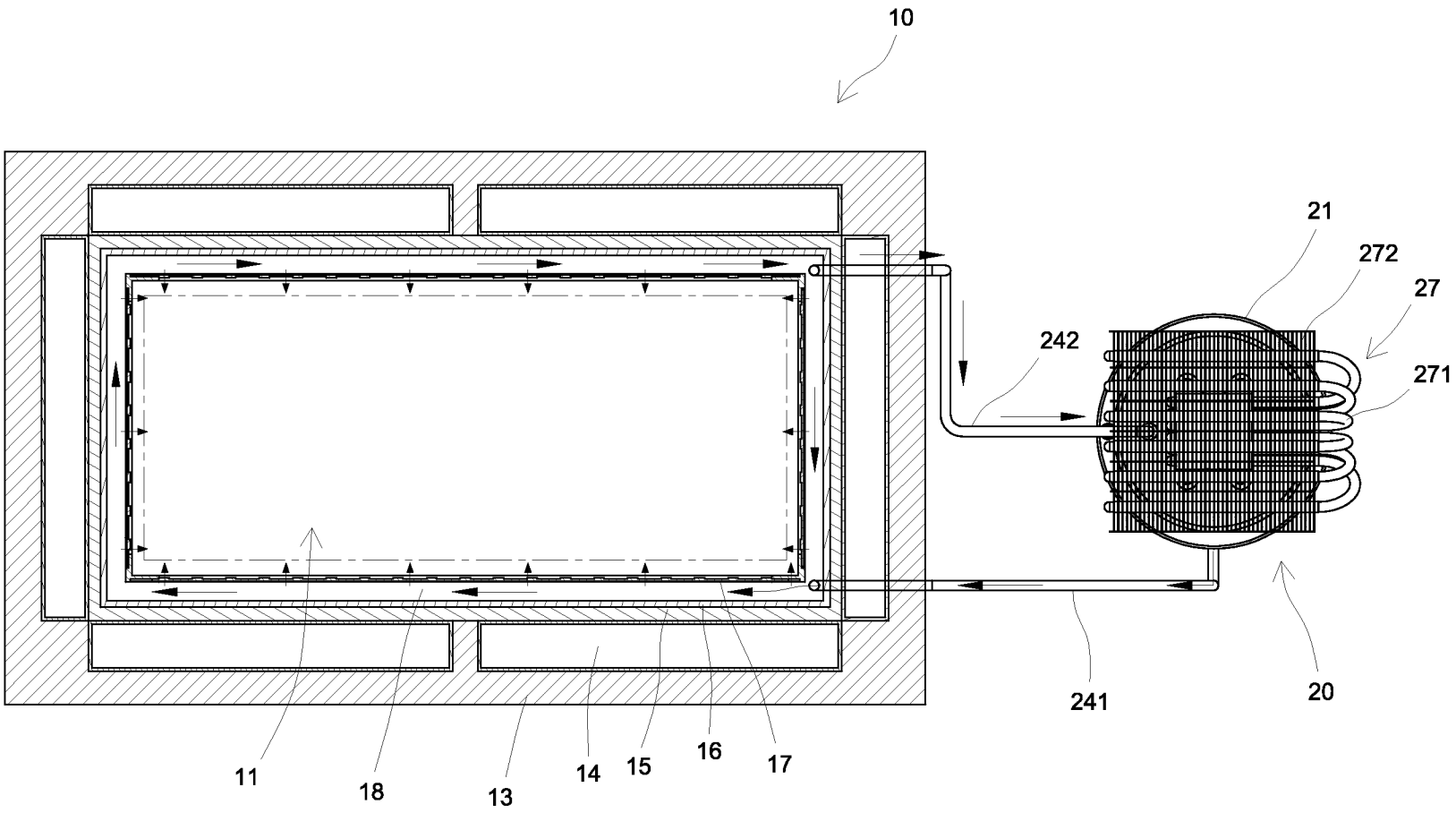
FIG. 8 is a horizontal cross-sectional schematic view of the box and the refrigeration device of the second embodiment of the present invention.
Figure 9:
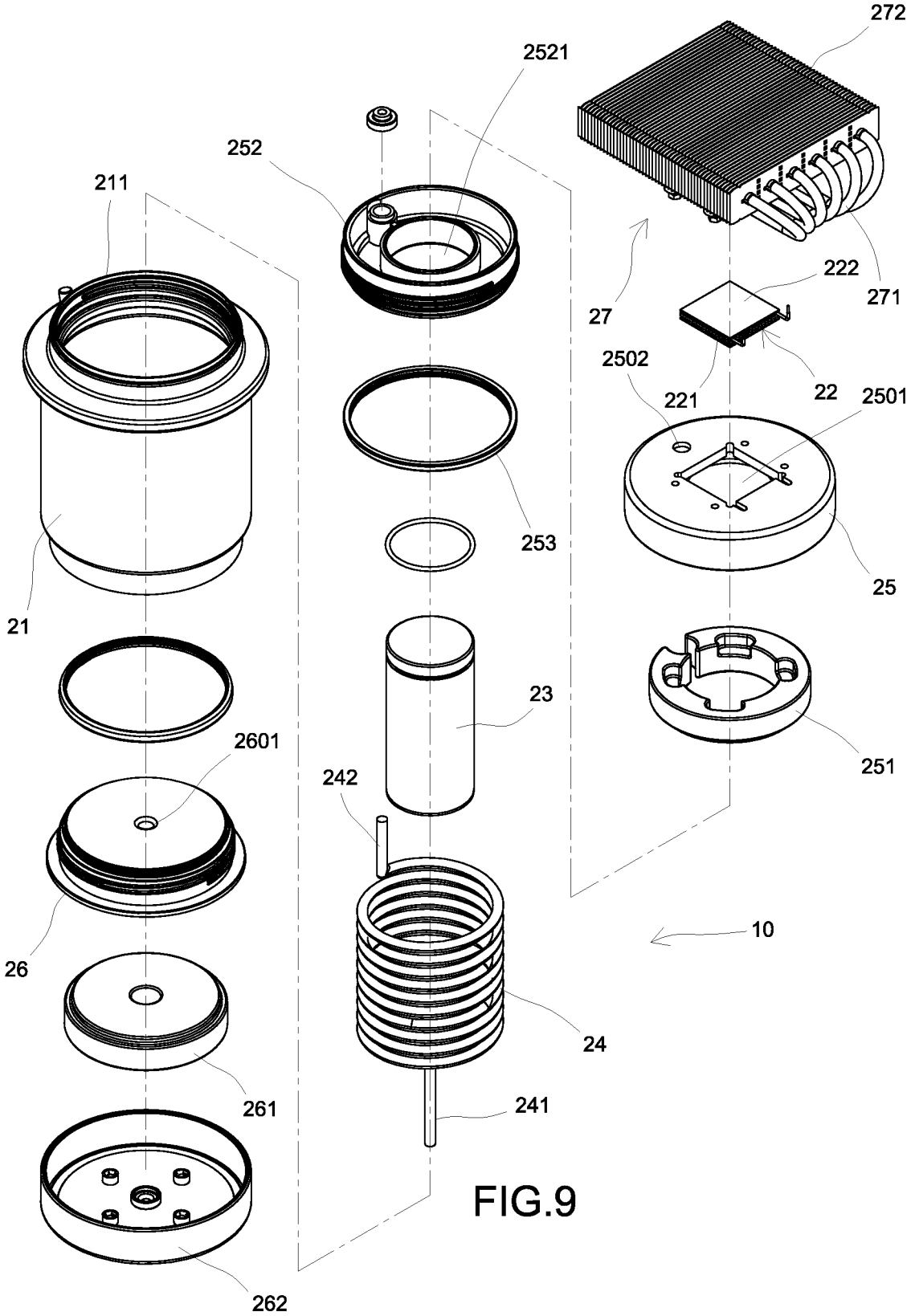
FIG. 9 is an exploded three-dimensional schematic view of the refrigeration device of the second embodiment of the present invention.

Referring to FIGS. 1 to 4, which show a first embodiment of the present invention, wherein a box 10 for logistics use is provided with a cold storage space 11 and a cover 12. The box 10 is separated from outside-in into an outer thermal insulating layer 13, a plurality of vacuum plates 14, an inner thermal insulating layer 15, an inner wall plate 16, and a plurality of temperature equalization plates 17. A cooling space 18 is provided between the inner wall plate 16 and the plurality of temperature equalization plates 17, and an internal space surrounded by the temperature equalization plates 17 is the cold storage space 11. A return inlet flow pipe 241 and a return outlet flow pipe 242 respectively channel cooling liquid into and out of the cooling space 18.

According to the above-described structural assembly, the first embodiment of the present invention channels a cooling liquid into the cooling space 18 from the return inlet flow pipe 241, and after completing filling the cooling space 18 with the cooling liquid, extremities of the return outlet flow pipe 242 and the return inlet flow pipe 241 are respectively sealed (using stopper ends for example), thereby causing the cold storage space 11 of the box 10 to lower in temperature, which enables preserving goods stored inside the cold storage space 11 at a low temperature for a period of time. When the temperature of the cold storage space 11 rises, the original cooling liquid is channeled out from the return outlet flow pipe 242, whereupon newly cooled liquid is again channeled into the cooling space 18 from the return inlet flow pipe 241, which again lowers the temperature of the cold storage space 11. Through such a repeated cooling process, the box 10 is provided with logistics use for over a short distance.

Figure 10:
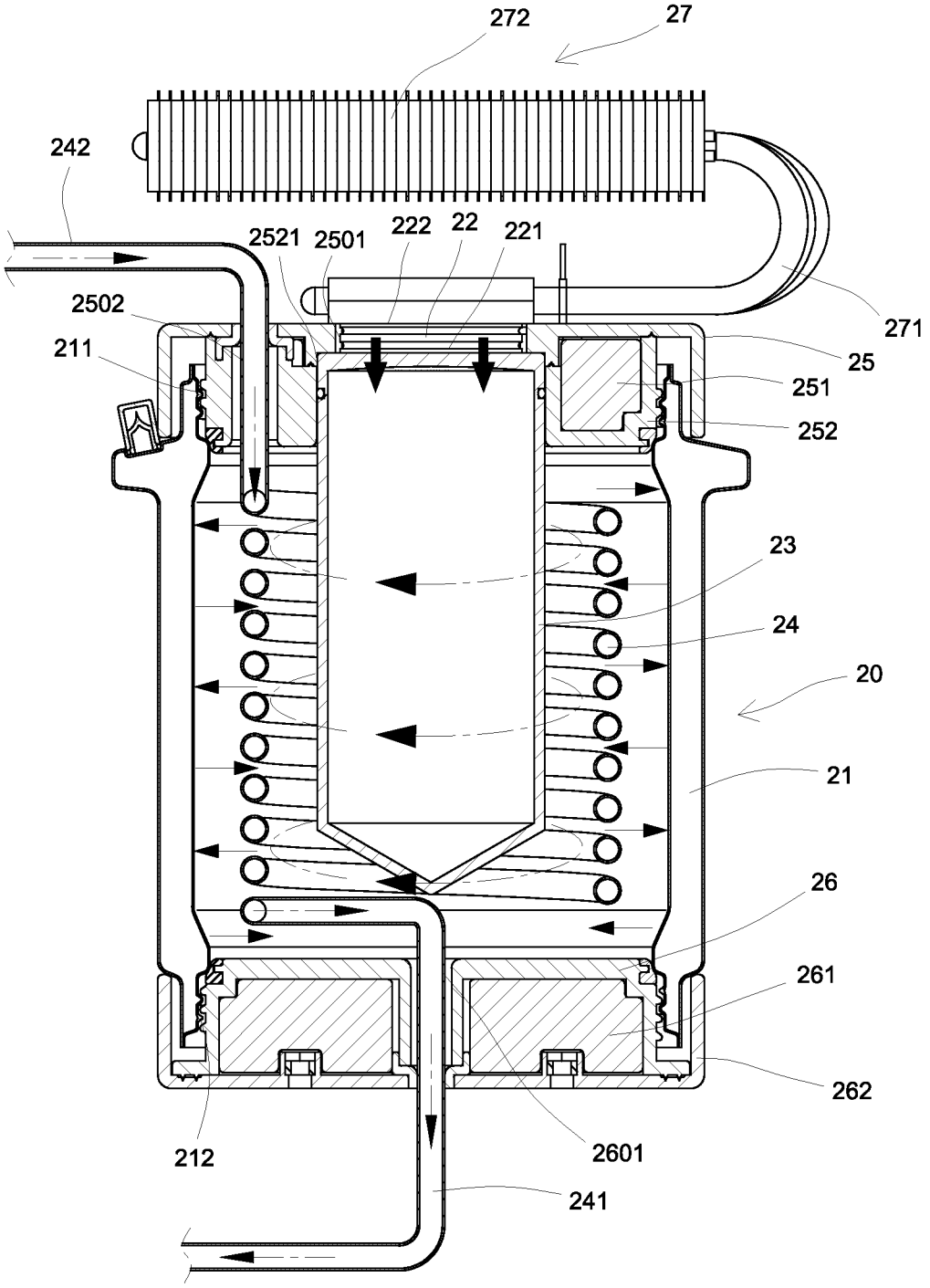
FIG. 10 is a cross-sectional schematic view of the refrigeration device of the second embodiment of the present invention.
Figure 11:
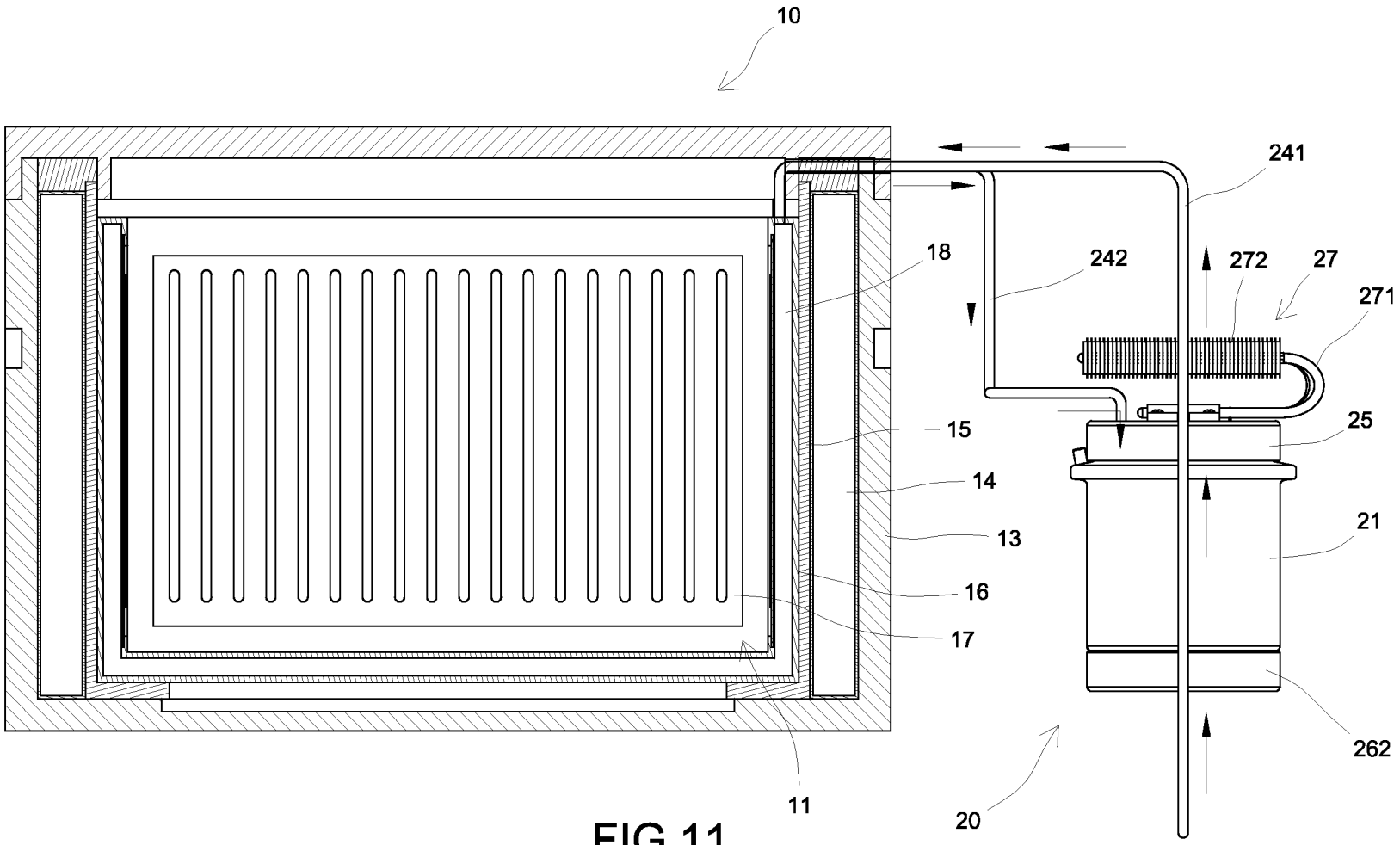
FIG. 11 is a longitudinal cross-sectional schematic view of the box and the refrigeration device of the second embodiment of the present invention.

Referring to FIGS. 5 to 9, which show a second embodiment of the present invention, wherein a refrigeration device 20 is used to transmit cold from a cold source into the box 10. The refrigeration device 20 is a chamber structure 21, which is provided with a refrigeration chip 22, a superconducting cold pipe 23, an inner return flow pipe 24, a return inlet flow pipe 241, a return outlet flow pipe 242, and a heat sink 27. The chamber structure 21 is made from thermal insulation material, the top portion of which is fitted with the refrigeration chip 22 and the heat sink 27. The interior of the chamber structure 21 is fitted with the superconducting cold pipe 23, and the refrigeration chip 22 transmits cold from a cold source to the superconducting cold pipe 23. The inner return flow pipe 24 wraps round the exterior of the superconducting cold pipe 23; one end of the inner return flow pipe 24 connects to the return inlet flow pipe 241 and the other end connects to the return outlet flow pipe 242. The return inlet flow pipe 241 and the return outlet flow pipe 242 respectively channel cold into and out of the cooling space 18 of the box 10. The interior of the superconducting cold pipe 23 is filled with a cooling liquid, and the interior of the chamber structure 21 is filled with a cooling liquid. The inner return flow pipe 24, the return inlet flow pipe 241, the return outlet flow pipe 242, and the cooling space 18 inside the box 10 are all filled with the cooling liquid. The inner return flow pipe 24, the return inlet flow pipe 241, and the return outlet flow pipe 242 pertain to types of heat pipes. The chamber structure 21 of the refrigeration device 20 is fitted with an upper cover 25, an upper internal ring 251, a threaded internal ring 252, a plurality of leak stoppage rings 253, a threaded bottom cover 26, a bottom middle cover 261, and a bottom cover 262. The upper internal ring 251 is clamped between the upper cover 25 and the threaded internal ring 252, and the top portion of the upper cover 25 is provided with a top insert hole 2501, which enables disposing the refrigeration chip 22 therein. The threaded internal ring 252 is provided with an inner insert hole 2521, which enables fixedly positioning the superconducting cold pipe 23 therein. The inner wall of the upper portion of the chamber structure 21 is provided with an upper screw thread 211, which enables joining the threaded internal ring 252 thereto, enabling the upper cover 25, the upper internal ring 251, and the threaded internal ring 252 to be joined to the upper side of the chamber structure 21. The inner wall of the lower portion of the chamber structure 21 is provided with a lower screw thread 212 (as depicted in FIG. 10), which enables joining the threaded bottom cover 26 thereto. The bottom middle cover 261 is clamped between the threaded bottom cover 26 and the bottom cover 262, thereby enabling joining the threaded bottom cover 26, the bottom middle cover 261, and the bottom cover 262 to the lower portion of the chamber structure 21. The upper cover 25, the upper internal ring 251, and the threaded internal ring 252 are respectively provided with an outlet 2502, which enable the return outlet flow pipe 242 to penetrate therein. The threaded bottom cover 26, the bottom middle cover 261, and the bottom cover 262 are respectively provided with an inlet 2601, which enable the return inlet flow pipe 241 to penetrate thereout. The refrigeration chip 22 is provided with a refrigeration surface 221 and a radiating surface 222, wherein the refrigeration surface 221 contacts the top surface of the superconducting cold pipe 23, and the radiating surface 222 contacts the heat sink 27. The heat sink 27 is fitted with a plurality of heat pipes 271 and heat dissipating fins 272. In addition, the refrigeration chip 22 is fitted with a switch that has an external connection power cord and a control IC, which are well known to those of skill in the art and not further detailed herein.

According to the above-described structural assembly, in the second embodiment of the present invention shown in FIGS. 8 to 11, the refrigeration surface 221 of the refrigeration chip 22 produces a cold source and concurrently uses the radiating surface 222 to produce a heat source. The heat pipes 271 and the heat dissipating fins 272 of the heat sink 27 dissipate heat outward, and cold from the cold source is transmitted to the superconducting cold pipe 23, whereupon the superconducting cold pipe 23 gradually cools down. Apart from lowering the temperature of the cooling liquid inside the superconducting cold pipe 23, the cooling liquid inside the chamber structure 21 is also lowered in temperature, at which time, the inner return flow pipe 24 wrapped round the exterior of the superconducting cold pipe 23 also gradually cools down. Cold from the cold source passes through the return inlet flow pipe 241 of the inner return flow pipe 24 and continuously enters the interior of the cooling space 18 of the box 10. The temperature equalization plates 17 continuously lower the temperature of the cold storage space 11 inside the box 10, and the cooling liquid from the cooling space 18 of the box 10 flows back into the refrigeration device 20 through the return outlet flow pipe 242 to repeat the cooling process. Such a cyclic cooling process maintains the set temperature of the cold storage space 11 of the box 10 to achieve a constant set temperature.

The second embodiment of the present invention uses the refrigeration device 20 connected to the logistics box 10 to lower the temperature of goods placed therein and maintain a cold temperature. The present invention is distinct from high cost, high fuel consumption, and large sized refrigeration equipped logistics vehicles, and is also distinct from cold storage logistics boxes that are only able to provide temporary thermal insulation. The present invention is capable of continuous temperature control and enables maintaining constant temperature of goods. Moreover, the present invention has low power consumption, and can be produced in various size dimensions according to operator requirements, thereby enabling the refrigerated logistics box 10 to be carried on a motorcycle, or a plurality of the refrigerated logistics boxes 10 can be carried in a general truck, thus eliminating having to use high cost logistics vehicles with refrigerating equipment, as well as eliminating worry that the goods will spoil. In addition, because of its low power consumption, the required battery is small in size, and thus can be easily carried by a motorcycle or a truck. Hence, the present invention is convenient and is of low cost, and is also provided with a substantive improved utility function. In addition, the positive and negative poles of the power supply for the refrigeration chip 22 can be interchanged to function as a heating device to maintain the temperature required for thermal insulated food products, while ensuring the temperature will not drop. Accordingly, the present invention can be transformed to produce the required temperature function.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A refrigerated logistics box, comprising:

a box for logistics use, which is provided with a cold storage space and a cover, wherein the box is configured with a plurality of thermal insulating layers and temperature equalization plates; the box is separated from outside-in into an outer thermal insulating layer, a plurality of vacuum plates, an inner thermal insulating layer, an inner wall plate, and the temperature equalization plates; a cooling space is provided between the inner wall plate and the temperature equalization plates, and an inner space surrounded by the temperature equalization plates is the cold storage space; and a return outlet flow pipe and a return inlet flow pipe, which respectively channel cooling liquid out of and into the cooling space;

whereby, cooling liquid is channeled into the cooling space from the return inlet flow pipe, which causes the cold storage space of the box to lower in temperature; when the temperature of the cold storage space rises, the original cooling liquid is channeled out from the return outlet flow pipe and newly cooled liquid is again channeled into the cooling space from the return inlet flow pipe, wherein the return outlet flow pipe and the return inlet flow pipe are externally connected to a refrigeration device; the refrigeration device is a chamber structure, which is provided with a refrigeration chip, a superconducting cold pipe, an inner return flow pipe, and a heat sink; the chamber structure is made from thermal insulation material, the top portion of which is fitted with the refrigeration chip and the heat sink, the interior of the chamber structure is fitted with the superconducting cold pipe, and the refrigeration chip transmits cold from a cold source to the superconducting cold pipe, the inner return flow pipe wraps round the exterior of the superconducting cold pipe, and one end of the inner return flow pipe connects to the return outlet flow pipe, the other end thereof connects to the return inlet flow pipe; moreover, the return outlet flow pipe and the return inlet flow pipe respectively channel cooling liquid out of and into the cooling space of the box; the cold source of the refrigeration device continuously transmits cold into the box from the return inlet flow pipe, and then the return outlet flow pipe inverse channels the cooling liquid from the box back into the refrigeration device for further lowering of the temperature; such a cyclic cooling process maintains the set temperature of the cold storage space of the box.

2. The refrigerated logistics box according to claim 1, wherein the refrigeration chip is provided with a refrigeration surface and a radiating surface; the refrigeration surface contacts the superconducting cold pipe and the radiating surface contacts the heat sink, wherein the heat sink is provided with a plurality of heat pipes and heat dissipating fins.

3. The refrigerated logistics box according to claim 1, wherein the chamber structure of the refrigeration device is fitted with an upper cover, an upper internal ring, a threaded internal ring, a plurality of leak stoppage rings, a threaded bottom cover, a bottom middle cover, and a bottom cover; the upper internal ring is clamped between the upper cover and the threaded internal ring, and the top portion of the upper cover is provided with a top insert hole, which enables disposing the refrigeration chip therein; the threaded internal ring is provided with an inner insert hole, which enables fixedly positioning the superconducting cold pipe therein; an inner wall of the upper portion of the chamber structure is provided with an upper screw thread, which enables joining the threaded internal ring thereto, an inner wall of the lower portion of the chamber structure is provided with a lower screw thread, which enables joining the threaded bottom cover thereto; the bottom middle cover is clamped between the threaded bottom cover and the bottom cover; the upper cover, the upper internal ring, and the threaded internal ring are respectively provided with an outlet, which enable the return outlet flow pipe to penetrate therein; the threaded bottom cover, the bottom middle cover, and the bottom cover are respectively provided with an inlet, which enable the return inlet flow pipe to penetrate thereout.

4. The refrigerated logistics box according to claim 1, wherein the interior of the superconducting cold pipe is filled with cooling liquid, and the interior of a chamber structure is filled with cooling liquid.

* * * * *